US007926909B2

(12) United States Patent
Hayakawa et al.

(10) Patent No.: US 7,926,909 B2
(45) Date of Patent: Apr. 19, 2011

(54) INK-JET RECORDING HEAD, METHOD FOR MANUFACTURING INK-JET RECORDING HEAD, AND SEMICONDUCTOR DEVICE

(75) Inventors: Kazuhiro Hayakawa, Kawasaki (JP); Masaya Uyama, Yokohama (JP); Makoto Terui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 238 days.

(21) Appl. No.: 11/970,396

(22) Filed: Jan. 7, 2008

(65) Prior Publication Data

US 2008/0165222 A1 Jul. 10, 2008

(30) Foreign Application Priority Data

Jan. 9, 2007 (JP) ..... 2007-001477
Nov. 8, 2007 (JP) ..... 2007-290676

(51) Int. Cl.
*B41J 2/135* (2006.01)
*B41J 2/05* (2006.01)

(52) U.S. Cl. ..... 347/44; 347/64

(58) Field of Classification Search ..... 347/44, 347/64

See application file for complete search history.

(56) References Cited

U.S. PATENT DOCUMENTS

2005/0285916 A1* 12/2005 Koyama et al. ..... 347/86
2006/0256162 A1* 11/2006 Hayakawa ..... 347/65

FOREIGN PATENT DOCUMENTS

JP 9-11478 1/1997

* cited by examiner

*Primary Examiner* — K. Feggins
*Assistant Examiner* — Lisa M Solomon
(74) *Attorney, Agent, or Firm* — Canon USA Inc IP Div

(57) ABSTRACT

An ink-jet recording head includes a substrate which has a first surface, a second surface opposed to the first surface, and energy-generating elements arranged above the first surface and configured to generate energy used to discharge ink. The recording head also includes discharge ports through which the ink is discharged and arranged to correspond to the energy-generating elements, ink channels communicatively connected to the discharge ports, a supply port which extends from the first surface to the second surface of the substrate and which is communicatively connected to the ink channels, and a film extending over the wall of the supply port. The film further extends on the first surface of the substrate and is covered with a first layer extending from the first surface of the substrate.

7 Claims, 12 Drawing Sheets

INK-JET RECORDING HEAD, METHOD FOR MANUFACTURING INK-JET RECORDING HEAD, AND SEMICONDUCTOR DEVICE

BACKGROUND OF THE INVENTION

1. Field of the Invention

The present invention relates to an ink-jet recording head, a method for manufacturing the ink-jet recording head, and a semiconductor device.

2. Description of the Related Art

In the field of semiconductor devices, the following technique has been recently proposed to meet the need for downsizing portable electronic devices: a technique for three-dimensionally arranging devices to increase the packing density of the devices. The technique is as follows: semiconductor devices that have been two-dimensionally arranged are three-dimensionally arranged and signals are transmitted between the semiconductor devices through electrodes (through-hole electrodes) extending through each substrate having the semiconductor devices. The technique is more effective in achieving higher device-packing density as compared to conventional techniques for transmitting signals between two-dimensionally arranged semiconductor devices through wires arranged on printed circuit boards and is effective in downsizing apparatuses.

In the field of ink-jet recording heads (hereinafter referred to as recording heads in some cases), structures having supply ports extending through substrates have been proposed for various purposes. Japanese Patent Laid-Open No. 9-11478 discloses a recording head in which a protective layer is formed on the wall of a supply port such that a material (for example, silicon) for forming a substrate is prevented from being dissolved in ink.

A signal can be transmitted between the recording head and a recording unit body located on the side of the rear surface (a surface opposed to another surface having nozzles) of the recording head through a through-hole electrode. This configuration requires no wires for transmitting a signal. This leads to a reduction in the distance between the recording head and a recording medium, resulting in an increase in ink-landing accuracy. Therefore, high-quality images can be output.

In order to form through-hole electrodes in a semiconductor device, an insulating layer for insulating a conductive layer from a substrate needs to be formed. The insulating layer must be prevented from being peeled off from the conductive layer or the substrate if an external force is applied to the insulating layer in, for example, a step of bonding the semiconductor device to external electrodes. If a material having low affinity to other materials is used to form the insulating layer, the peeling of the insulating layer can particularly occur.

The recording head has the same problem as described above if the supply port is replaced with a through-hole present in the semiconductor device and the protective layer is replaced with the insulating layer. The ink used in the recording head may enter the interface between the substrate and the protective layer, which is disposed on the wall of the supply port. If the ink reaches the substrate and circulates through penetration routes, a large amount of the substrate material is dissolved in the ink. This causes a problem such as the blocking of discharge ports. Recording heads including such through-hole electrodes and supply ports have the same problem as described above.

SUMMARY OF THE INVENTION

The present invention provides a structure in which an insulating layer that is hardly peeled off from the wall of a through-hole in a semiconductor device. The present invention also provides a recording head in which a protective layer is hardly peeled off from the wall of a supply port and ink hardly reaches a substrate. Furthermore, the present invention provides a semiconductor device having the above structure and also provides a method for manufacturing such a recording head.

An ink-jet recording head according to an aspect of the present invention includes a substrate which has a first surface, a second surface opposed to the first surface, and energy-generating elements which are arranged above the first surface and which generate energy used to discharge ink. The recording head also includes discharge ports through which the ink is discharged and which are arranged to correspond to the energy-generating elements, ink channels communicatively connected to the discharge ports, a supply port which extends from the first surface to the second surface of the substrate and which is communicatively connected to the ink channels, and a film extending over the wall of the supply port. The film further extends on the first surface of the substrate and is covered with a first layer extending from the first surface of the substrate.

Further features of the present invention will become apparent from the following description of exemplary embodiments with reference to the attached drawings.

DESCRIPTION OF THE EMBODIMENTS

Figure 1:
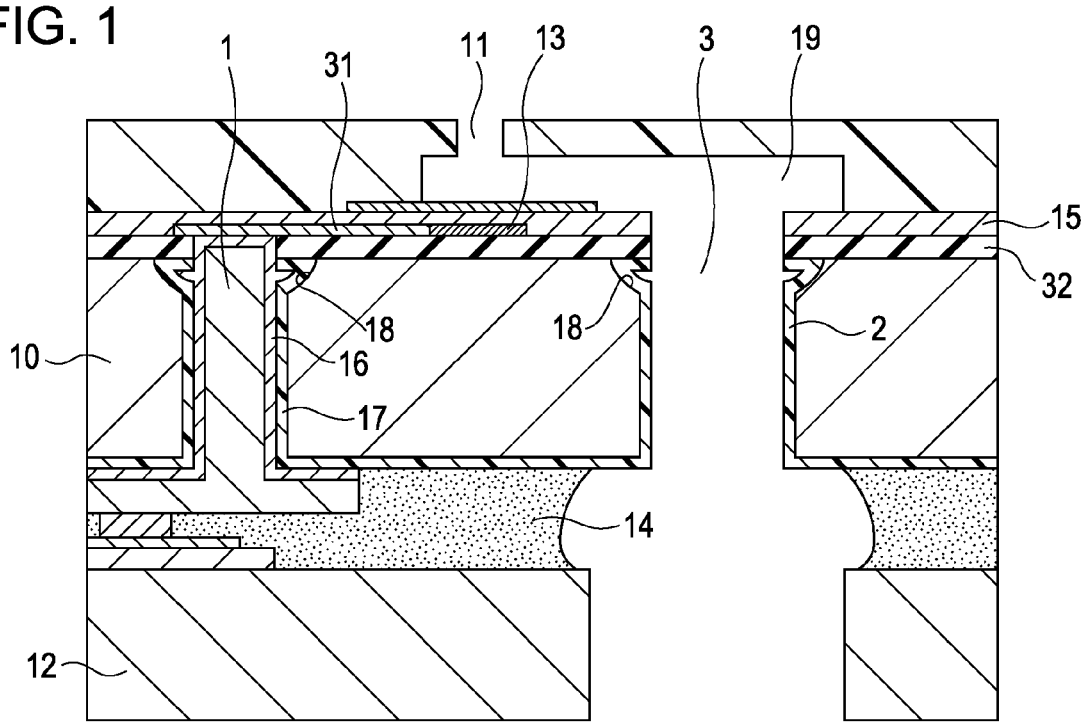
FIG. 1 is a schematic sectional view of an ink-jet recording head according to a first embodiment of the present invention.

Embodiments of the present invention will now be described with reference to the attached drawings. In descriptions below, members having the same function have the same reference numeral and will not be described in detail.

An ink-jet recording head that is an example of a liquid discharge head according to the present invention is described below. An application of the liquid discharge head is not limited to the ink-jet recording head. The liquid discharge head can be used to produce biochips or used to print electronic circuits.

A semiconductor device specified herein can be applied to ink-jet recording heads and can be used for various electronic components.

Ink-jet recording heads (hereinafter referred to as recording heads) according to embodiments of the present invention will now be described.

First Embodiment

Figure 15:
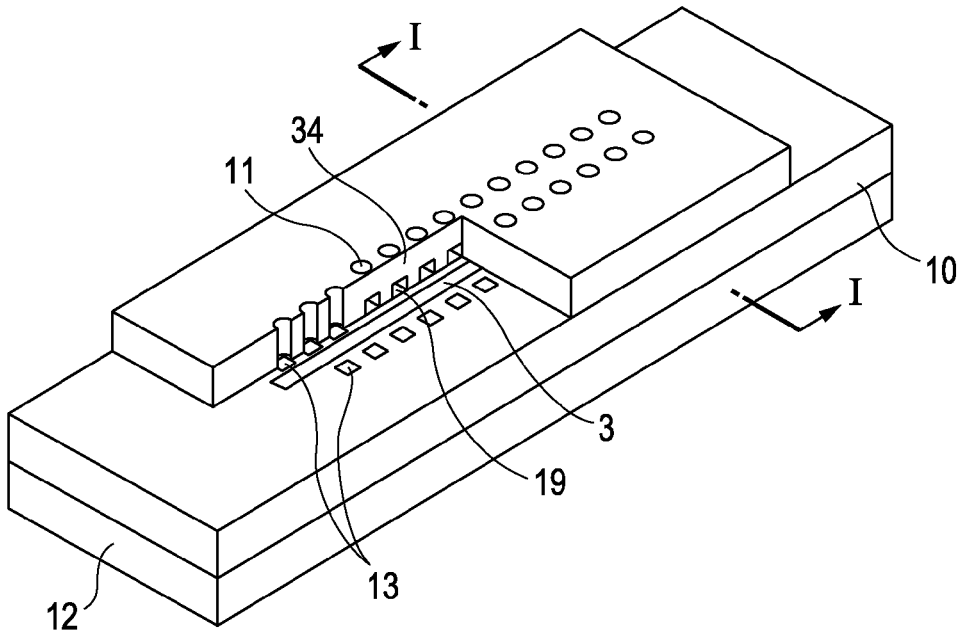
FIG. 15 is a schematic perspective view of the ink-jet recording head according to the first embodiment.

FIG. 15 shows a recording head according to a first embodiment of the present invention.

The recording head of this embodiment includes a substrate 10 having energy-generating elements 13, arranged at predetermined intervals in two rows, for generating the energy used to discharge ink. The substrate 10 has a supply port 3, disposed between the two rows of the energy-generating elements 13, for supplying the ink. A channel-forming member 34 is disposed on the substrate 10. The channel-forming member 34 has discharge ports 11 located above the energy-generating elements 13 and also has ink channels 19 extending from the supply port 3 to the discharge ports 11.

The recording head is placed such that a surface of the recording head that has the discharge ports 11 is opposed to a recording surface of a recording medium. The recording head records in such a manner that the pressure generated from the energy-generating elements 13 is applied to the ink supplied to the ink channels 19 through the supply port 3 such that droplets of the ink are discharged from the discharge ports 11 so as to be applied to the recording medium.

The configuration of the recording head will now be described in detail with reference to FIG. 1.

FIG. 1 is a schematic sectional view of the recording head taken along the line I-I of FIG. 15.

With reference to FIG. 1, the recording head includes through-hole electrodes 1 and the supply port 3. The wall of the supply port 3 is covered with a cover film 2. In semiconductor devices including through-hole electrodes only, recording heads including supply ports having protective layers have the same configuration as that of the recording head. The substrate 10 has a first surface on which an interlayer insulating layer 32, the energy-generating elements 13, and a passivation layer 15 are arranged in that order. The passivation layer 15 functions as a protective layer for protecting the energy-generating elements 13. With reference to FIG. 1, reference numeral 31 represents driving circuits that transmit signals for driving the energy-generating elements 13, reference numeral 16 represents a barrier layer, reference numeral 17 represents an insulating layer disposed between the substrate 10 and the through-hole electrodes 1, and reference numeral 18 represents recesses. The cover film 2 and the insulating film 17 are made of the same material. The following materials can be used to form the cover film 2 and the insulating film 17: poly(p-xylylene), polyurea, polyimide, and silicon dioxide. In particular, poly(p-xylylene) can be used because poly(p-xylylene) is highly resistant to the ink.

The cover film 2 and the insulating film 17 follow the shape of the recesses 18, which are disposed in the substrate 10, and have portions which are located at the first surface of the substrate 10 and which are covered with the interlayer insulating layer 32. This prevents the cover film 2 from being peeled off from the substrate 10.

The passivation layer 15 is made of silicon nitride (SiN) or the like. The interlayer insulating layer 32 is made of silicon dioxide ($SiO_2$) or the like. These materials can be used in embodiments below. The substrate 10 has a second surface opposed to the first surface. The cover film 2 and the insulating film 17 overlie the second surface of the substrate 10. The second surface of the substrate 10 is bonded to a chip plate 12 with a sealant 14.

In embodiments below, cover layers 2 and insulating layers 17 are prevented from being peeled off from substrates.

Second Embodiment

Figure 2:
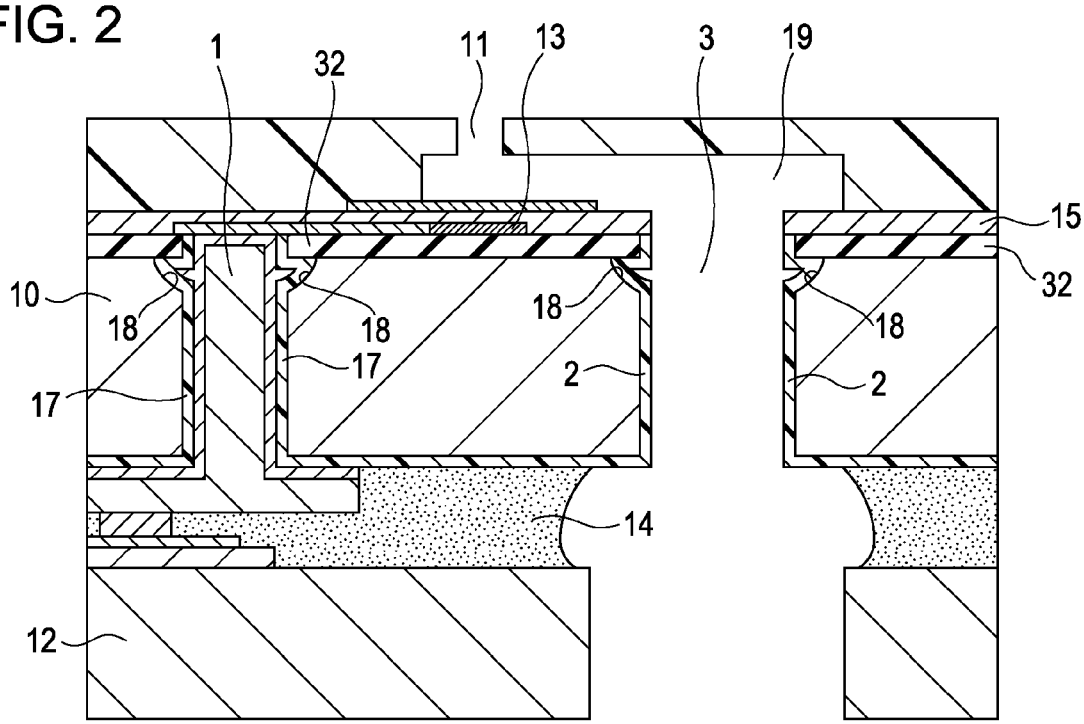
FIG. 2 is a schematic sectional view of an ink-jet recording head according to a second embodiment of the present invention.

FIG. 2, as well as FIG. 1, is a schematic sectional view of a recording head according to a second embodiment of the present invention. In the recording head, a cover film 2 is in contact with side surfaces of an interlayer insulating layer 32. The contact area between the cover film 2 and the interlayer insulating layer 32 is greater than that between those shown in FIG. 1. Therefore, the recording head has a hermetically sealed structure.

Third Embodiment

Figure 3:
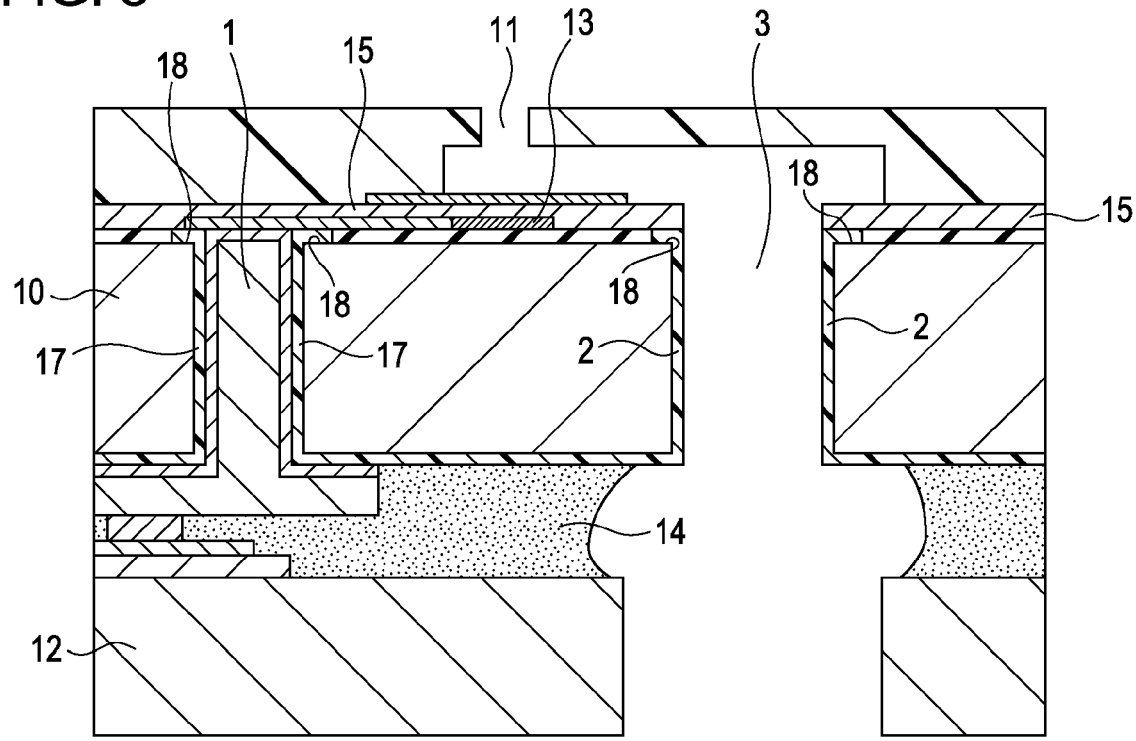
FIG. 3 is a schematic sectional view of an ink-jet recording head according to a third embodiment of the present invention.

FIG. 3, as well as FIG. 1, is a schematic sectional view of a recording head according to a third embodiment of the present invention. In the recording head, an insulating film 17 and a cover film 2 are sandwiched between a passivation layer 15 and a substrate 10. The insulating film 17 is hardly peeled off from the cover film 2; hence, ink is prevented from reaching the substrate 10. The insulating film 17 underlies the passivation layer 15 and driving circuits 31.

Fourth Embodiment

Figure 4:
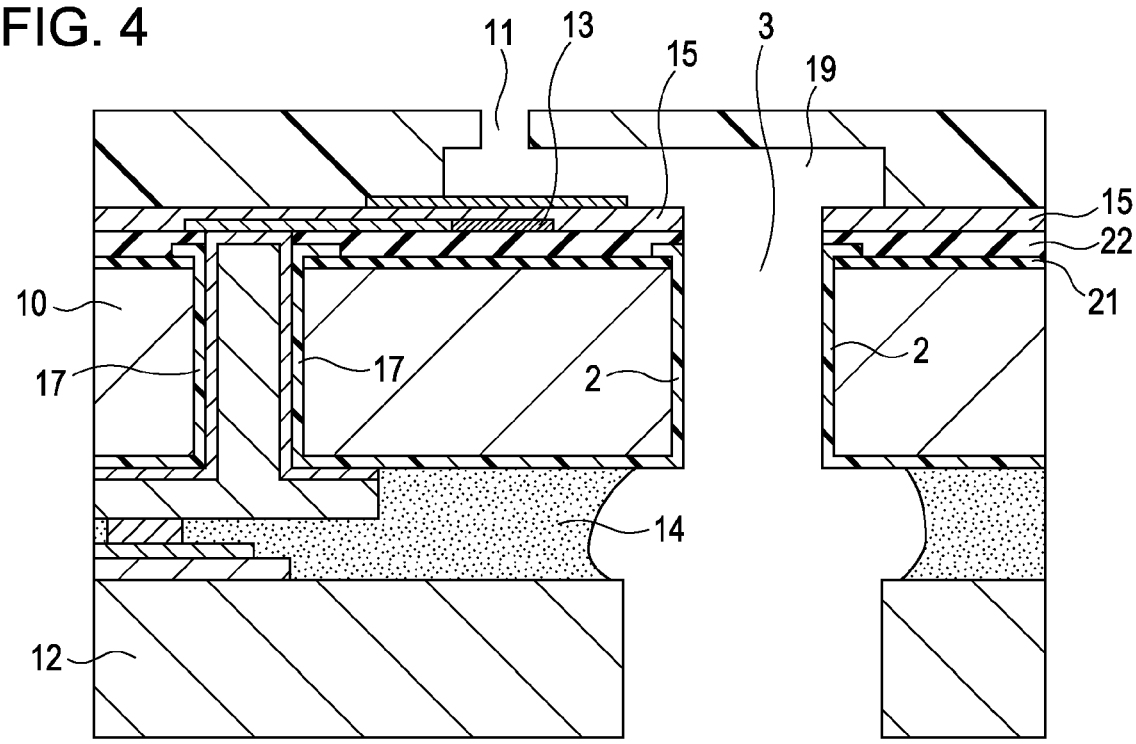
FIG. 4 is a schematic sectional view of an ink-jet recording head according to a fourth embodiment of the present invention.

FIG. 4, as well as FIG. 1, is a schematic sectional view of a recording head according to a fourth embodiment of the present invention. In the recording head, two functional layers, that is, an insulating film 17 and a cover film 2 are sandwiched between a thermal oxide layer 21 used for element isolation and an interlayer insulating layer 22 used to insulate wires from each other.

Fifth Embodiment

Figure 10A:
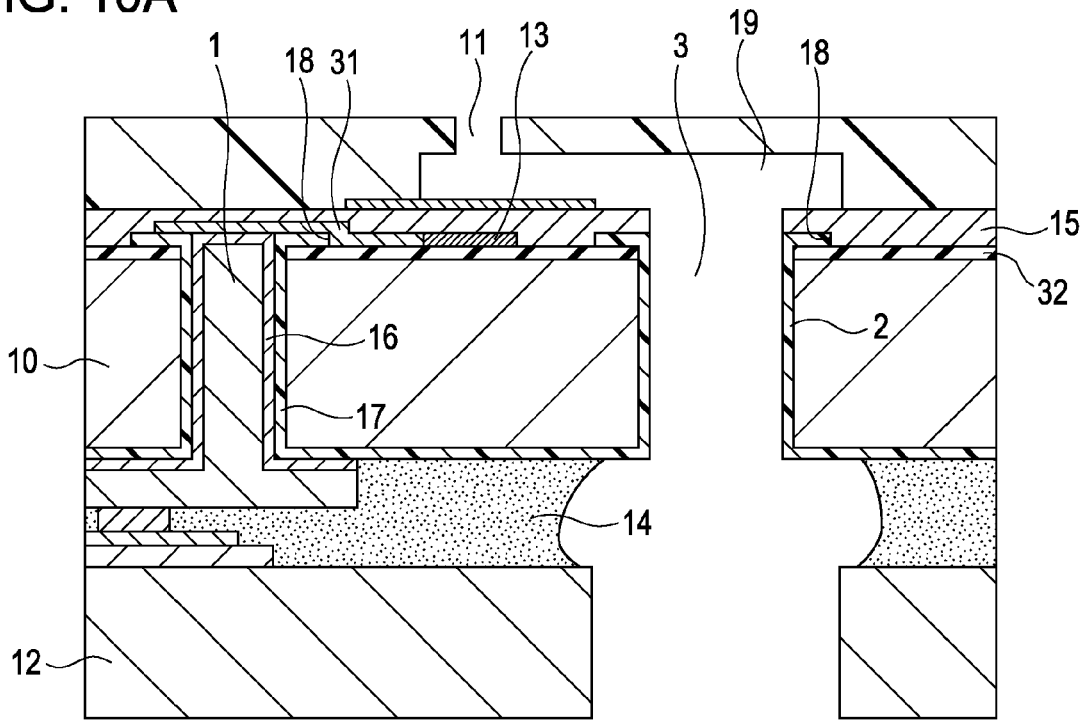
FIGS. 10A and 10B are schematic sectional views of an ink-jet recording head according to a fifth embodiment of the present invention.
Figure 10B:
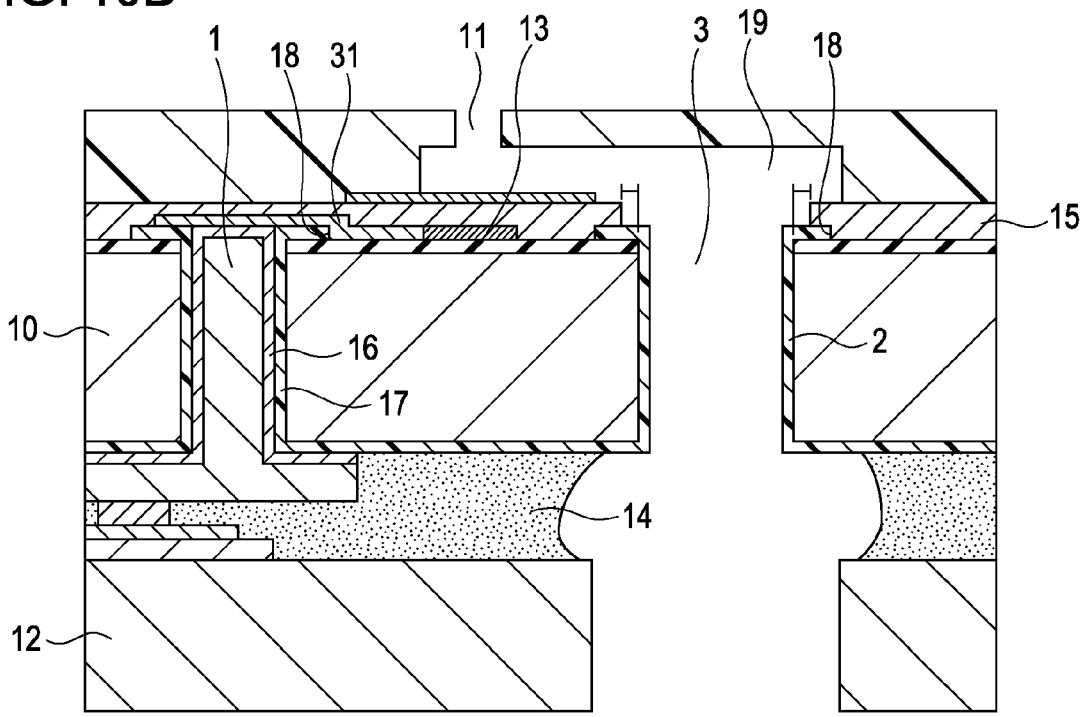

FIGS. 10A and 10B, as well as FIG. 1, are schematic sectional views of a recording head according to a fifth embodiment of the present invention. With reference to FIG. 10A, two functional layers, that is, an insulating film 17 and a cover film 2 are sandwiched between a thermal oxide layer 32 and an interlayer insulating layer 15. Portions of the insulating film 17 are disposed under wires 31.

As shown in FIG. 10B, an end of the passivation layer 15 that is located near a supply port 3 may be spaced from the wall of the supply port 3. This configuration is effective in the case where a stress is applied to the cover film 2. The tensile stress applied to the cover film 2 exerts in the direction parallel to the wall of the supply port 3, that is, in the direction perpendicular to a substrate 10. The passivation layer 15 is located at a position spaced from an axis extending along a side wall of the cover film 2; hence, the tensile stress applied to the cover film 2 probably has less influence on the passivation layer 15. Therefore, the cover film 2 is tightly bonded to the passivation layer 15. This prevents ink from entering the interface between the passivation layer 15 and the cover film 2.

Sixth Embodiment

Figure 13A:
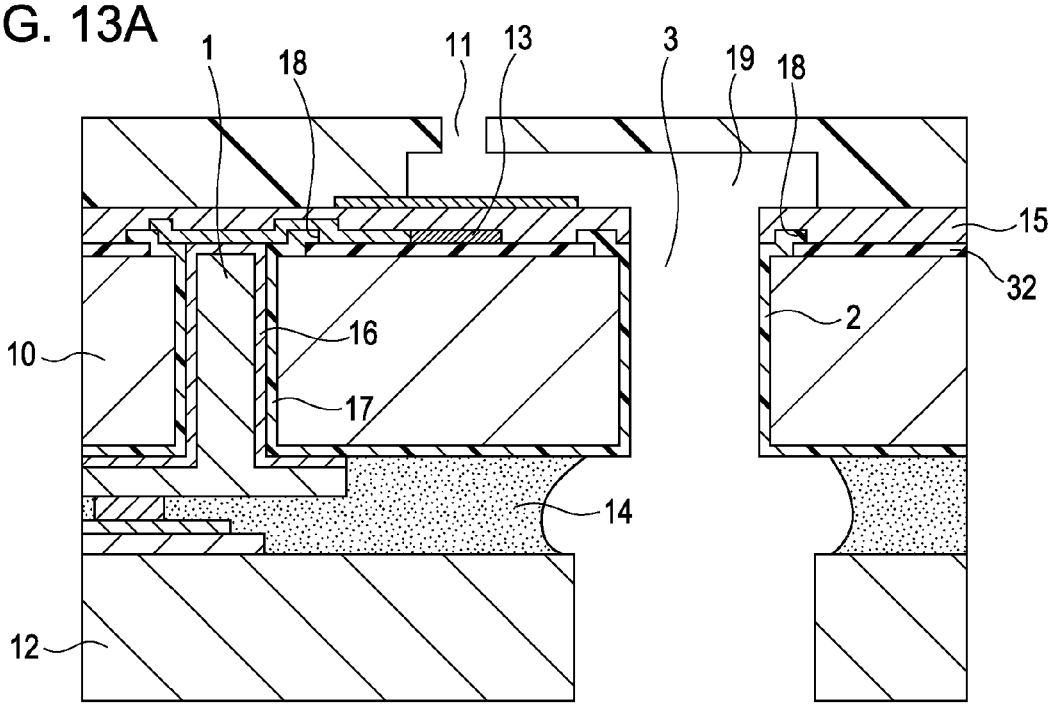
FIGS. 13A and 13B are schematic sectional views of an ink-jet recording head according to a sixth embodiment of the present invention.
Figure 13B:
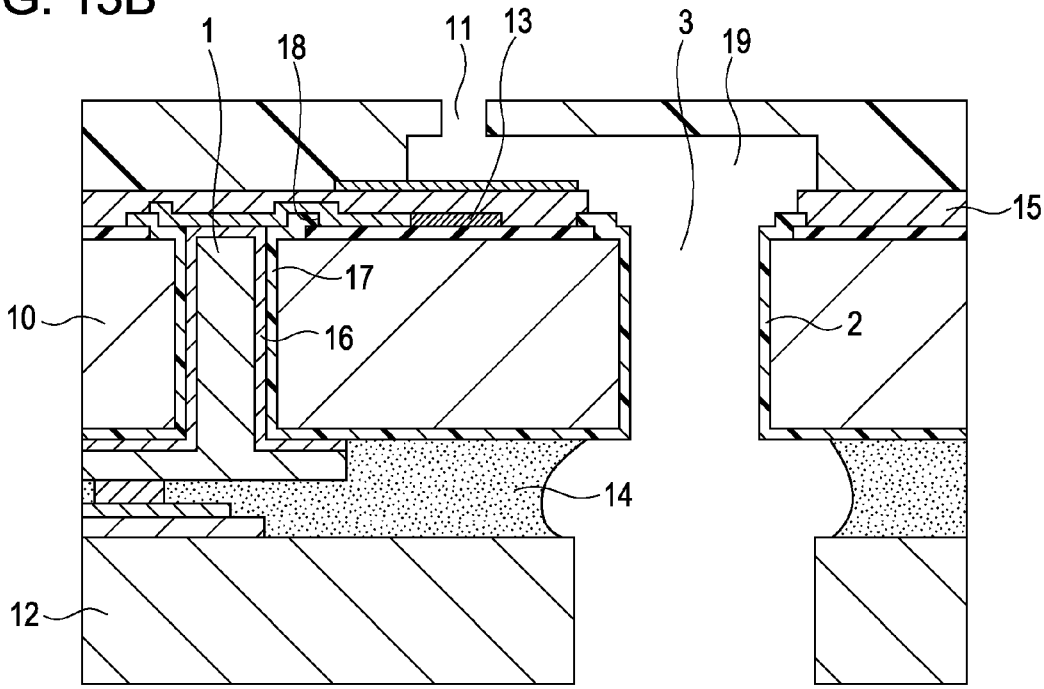

FIGS. 13A and 13B, as well as FIG. 1, are schematic sectional views of a recording head according to a sixth embodiment of the present invention. With reference to FIG. 13A, an insulating film 17 and a cover film 2 are sandwiched between a passivation layer 15 and an interlayer insulating layer 32 made of silicon dioxide and also sandwiched between the passivation layer 15 and a substrate 10. In this embodiment, recesses are spaces formed by setting back functional layers and other spaces are present between the functional layers. The insulating film 17 and the cover film 2 extend in the recesses.

As shown in FIG. 13B as well as FIG. 10B, an end of the passivation layer 15 that is located near a supply port 3 is spaced from the wall of the supply port 3. This configuration, as well as that described in the fifth embodiment, is probably effective in tightly bonding the passivation layer 15 to the cover film 2.

Seventh Embodiment

A method for manufacturing a recording head according to a seventh embodiment of the present invention will now be described in detail. The recording head shown in FIG. 1 is used to describe the method.

Figure 5A:
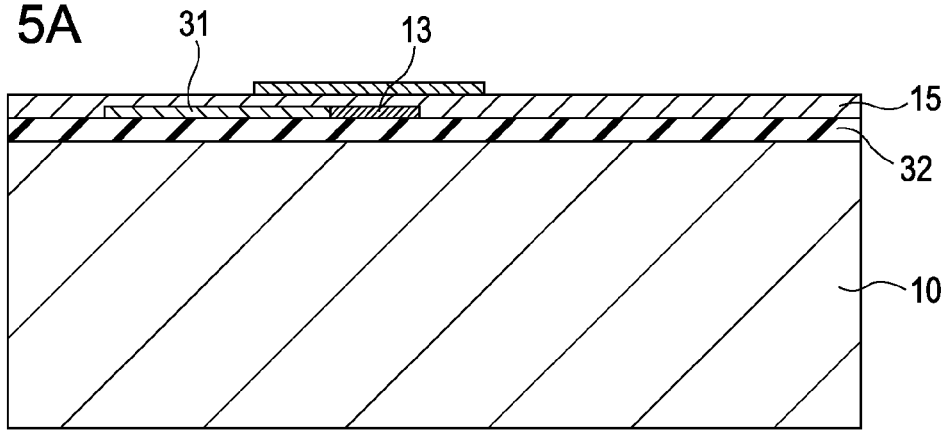
FIGS. 5A to 5C are schematic sectional views illustrating steps of a method for manufacturing an ink-jet recording head according to a seventh embodiment of the present invention.
Figure 5B:
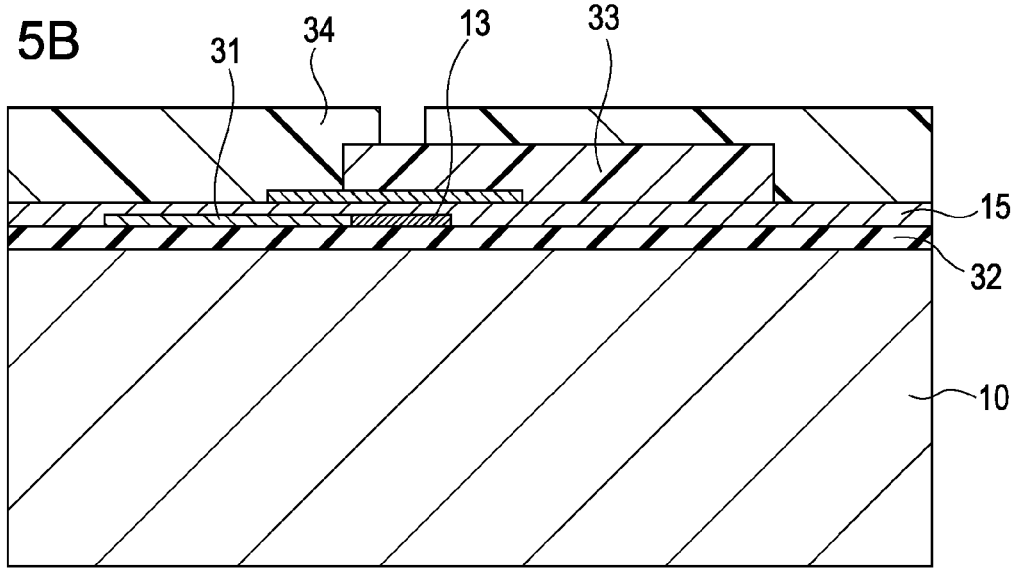
Figure 5C:
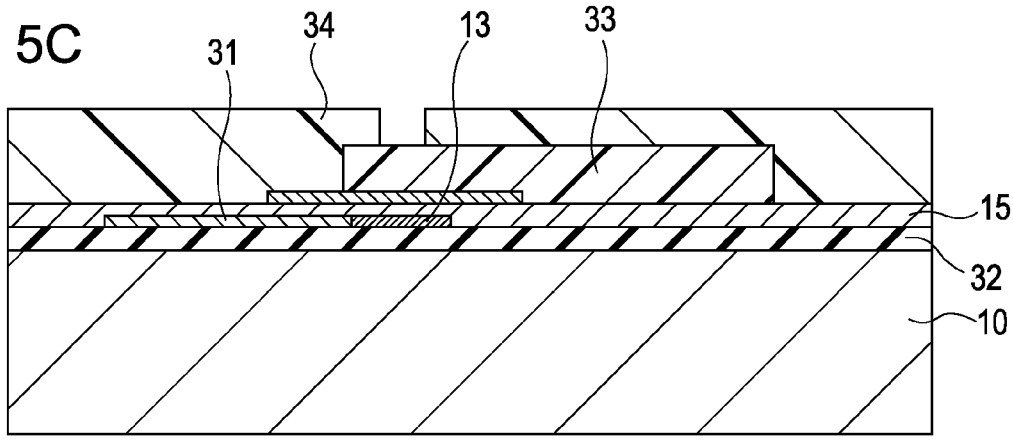

FIGS. 5A to 5C are schematic sectional views illustrating steps of the method.

As shown in FIG. 5A, the interlayer insulating layer 32, made of silicon dioxide, for insulating the energy-generating elements 13 and the driving circuits 31 is formed on the substrate 10 made of single-crystalline silicon by a common semiconductor process. The interlayer insulating layer 32 functions as an etching stop layer. The passivation layer 15 is formed over the energy-generating elements 13 using silicon nitride.

Polyetheramide (not shown) is applied to the passivation layer 15 and then baked, whereby an adhesive layer is formed. A novolak-based photoresist is applied to the adhesive layer.

The novolak-based photoresist is patterned by photolithography. The following portions are removed by chemical dry etching (CDE) using carbon tetrafluoride ($CF_4$) and oxygen ($O_2$): portions of the adhesive layer that are located on the energy-generating elements 13, pads connected to external electrodes, and a position for forming the supply port 3. The novolak-based photoresist is removed with a peeling solution containing monoamine.

As shown in FIG. 5B, the substrate 10 is coated with polymethyl isopropenyl ketone by spin coating. The coating is pre-baked at 120° C. for 20 minutes, exposed with ultraviolet (UV) light, developed with a mixture prepared by mixing methyl isobutyl ketone and xylene at a ratio of 2:1, and then rinsed with xylene. This allows a soluble resin layer 33 to be formed above the substrate 10 as shown in FIG. 5B. The resin layer 33 is used to form the ink channels 19, which extend between the supply port 3 and the discharge ports 11 as shown in FIG. 1.

A cationically polymerizable epoxy resin is applied to the passivation layer 15, whereby a cover resin layer 34 is formed. A photosensitive water repellent is applied to the cover resin layer 34. The discharge ports 11 are formed in the cover resin layer 34 by photolithography. The discharge ports 11 may be formed in this step or a subsequent step.

As shown in FIG. 5C, a support plate (not shown) for protecting the cover resin layer 34 is attached to the cover resin layer 34 with wax. The substrate 10 is thinned by back grinding, a crashed layer is removed from the substrate 10 with dilute fluoric acid, and a tape is then peeled off.

A novolak-based photoresist is applied to the rear surface of the substrate 10 and then patterned by photolithography such that portions located at positions for forming the supply port 3 and through-holes 35 for forming the through-hole electrodes 1 are removed from the novolak-based photoresist (not shown).

Figure 6A:
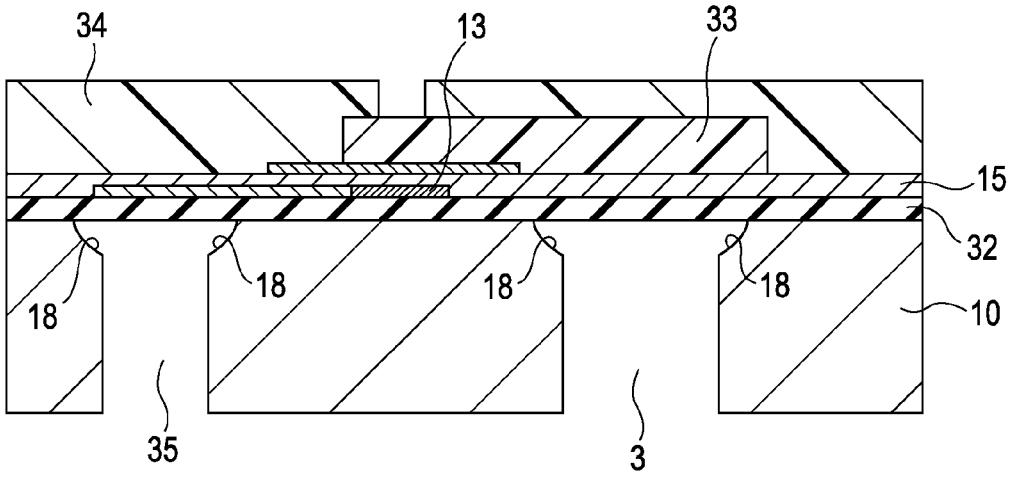
FIGS. 6A to 6C are schematic sectional views illustrating steps of the method according to the seventh embodiment.

The rear surface of the substrate 10 is etched with an ICP-RIE etcher, whereby the through-holes 35 and the supply port 3 are formed so as to extend from the rear surface of the substrate 10 to the interlayer insulating layer 32 as shown in FIG. 6A. Furthermore, portions of the substrate 10 that are in contact with the interlayer insulating layer 32, which is a functional layer on the substrate 10, are laterally etched by notching, whereby the recesses 18 are formed. A technique for forming the recesses 18 is not limited to notching.

Figure 6B:
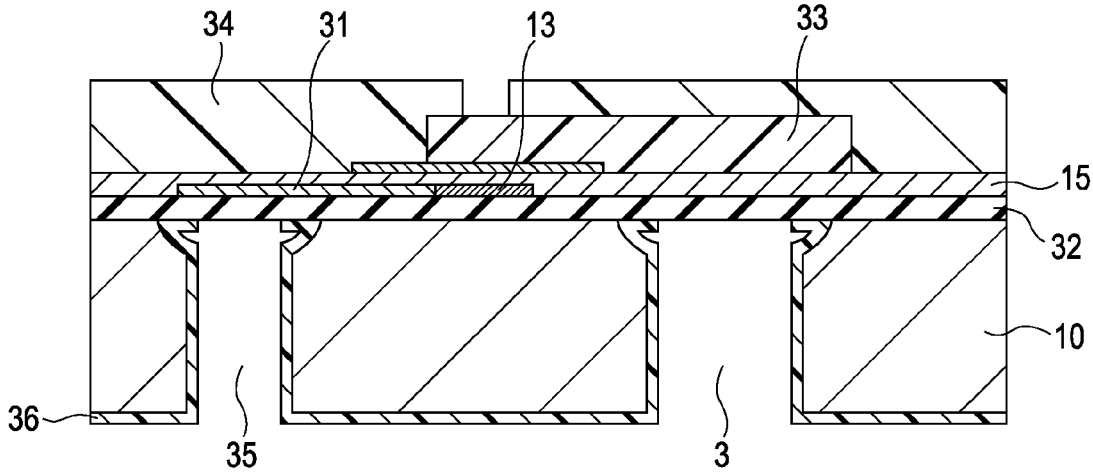

As shown in FIG. 6B, a poly(p-xylylene) film 36 for forming the insulating film 17 and cover film 2 shown in FIG. 1 is deposited on the substrate 10 by chemical vapor deposition (CVD). The poly(p-xylylene) film 36 extends over the walls of the through-holes 35 and the wall of the supply port 3. A dry film resist is deposited on the rear surface of the substrate 10 and then exposed. Portions of the dry film resist that are disposed on the through-holes 35 and the supply port 3 are removed. Portions of the poly(p-xylylene) film 36, which extends over the walls of the through-holes 35 and the wall of the supply port 3, are partly removed by reactive ion etching (RIE), the portions being in contact with the interlayer insulating layer 32. The dry film resist is then removed from the rear surface of the substrate 10.

When poly(tetrafluoro-p-xylylene), which is a type of poly (p-xylylene), is used, poly(tetrafluoro-p-xylylene) is deposited on the substrate 10 while the substrate 10 is being cooled in view of the deposition rate of poly(tetrafluoro-p-xylylene) on the substrate 10.

Figure 6C:
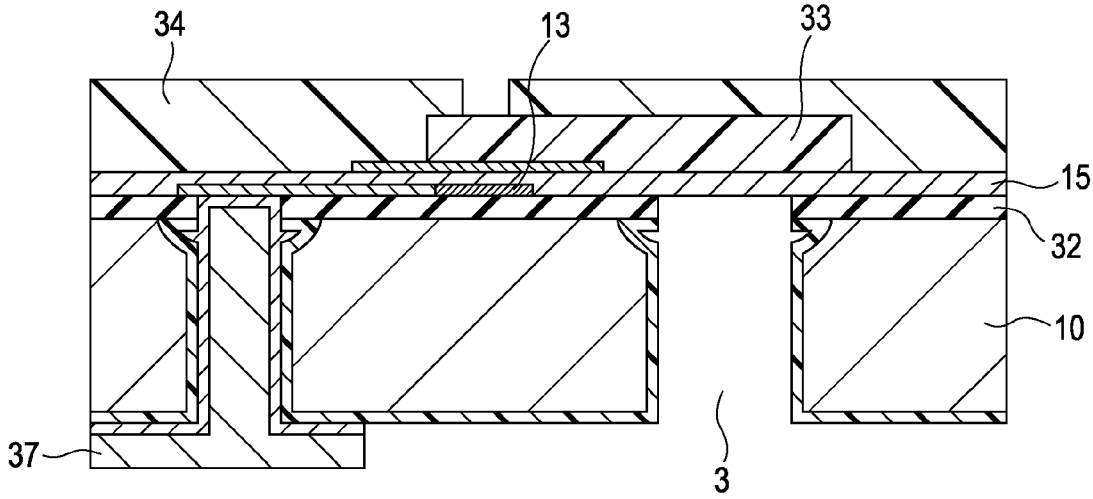

As shown in FIG. 6C, after portions of the interlayer insulating layer 32 that are exposed at the bottoms of the through-holes 35 and the bottom of the supply port 3 are removed by RIE, gold is deposited on the rear surface of the substrate 10 by sputtering, whereby a plating base layer is formed. A photosensitive dry film is attached to the plating base layer and then patterned by photolithography such that regions not used to form conductive layers are masked. A gold coating 37 for forming through-hole electrode layers and rear-surface conductive layers is formed on the plating base layer by plating in such a manner that a voltage is applied to the plating base layer. The photosensitive dry film is peeled off and portions of the plating base layer that are uncovered with the gold coating 37 are then removed.

Figure 7:
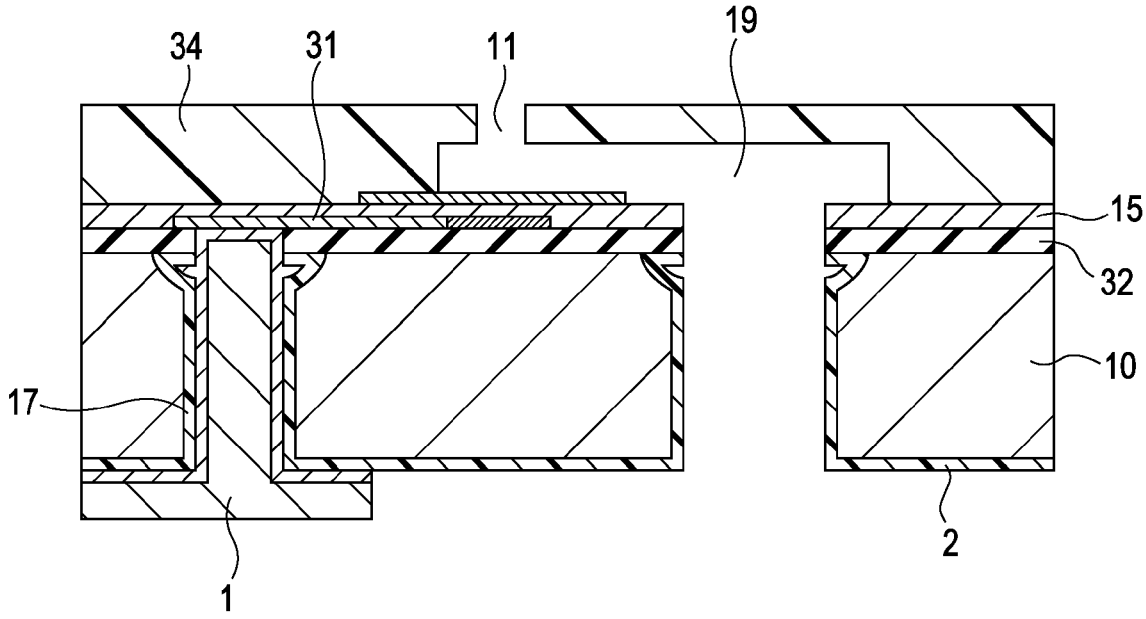
FIG. 7 is a sectional view illustrating a step of the method according to the seventh embodiment.

As shown in FIG. 7, after a portion of the passivation layer 15 that is exposed at the bottom of the supply port 3 is removed by CDE, the substrate 10 is immersed in methyl lactate, whereby the resin layer 33, which is soluble, is removed.

The substrate 10 is heated to a temperature at which the wax is melted, whereby the support plate is released from the substrate 10. The substrate 10 is cut with a dicer, whereby a chip is prepared. A cartridge is assembled in such a manner that the chip is attached to a chip plate and the through-hole electrodes 1 are connected to external electrodes, whereby the recording head shown in FIG. 1 is completed.

Eighth Embodiment

A method for manufacturing a recording head according to an eighth embodiment of the present invention will now be described.

The method of this embodiment includes the same step as that described in the seventh embodiment with reference to FIG. 6A. The formation of a supply port 3 and through-holes 35 is the same as that described above. In order to form the supply port 3 and the through-holes 35, notching may be used or not.

Figure 8A:
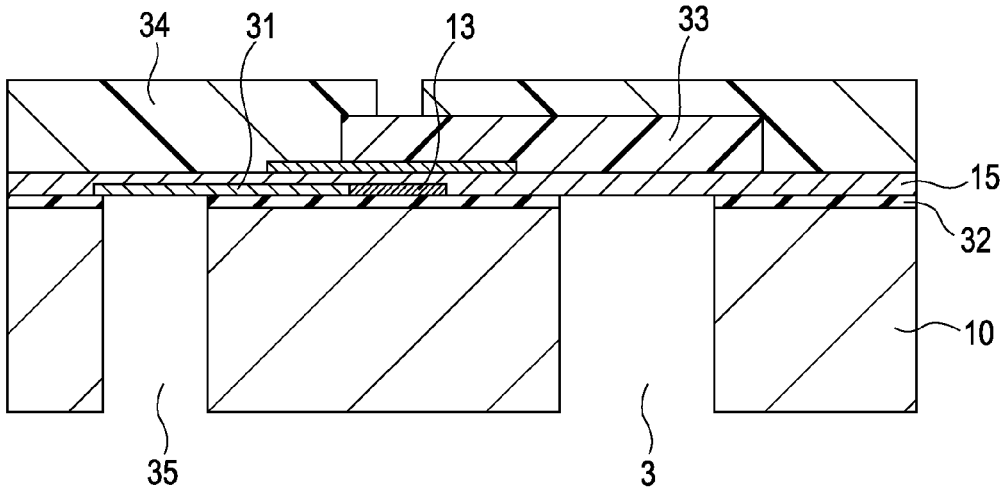
FIGS. 8A to 8C are schematic sectional views illustrating steps of a method for manufacturing an ink-jet recording head according to an eighth embodiment of the present invention.

As shown in FIG. 8A, portions of a silicon dioxide layer 32 that are exposed through the through-holes 35 and the supply port 3 are removed using buffered hydrogen fluoride (BHF). The silicon dioxide layer 32 functions as an interlayer insulating layer.

Figure 8B:
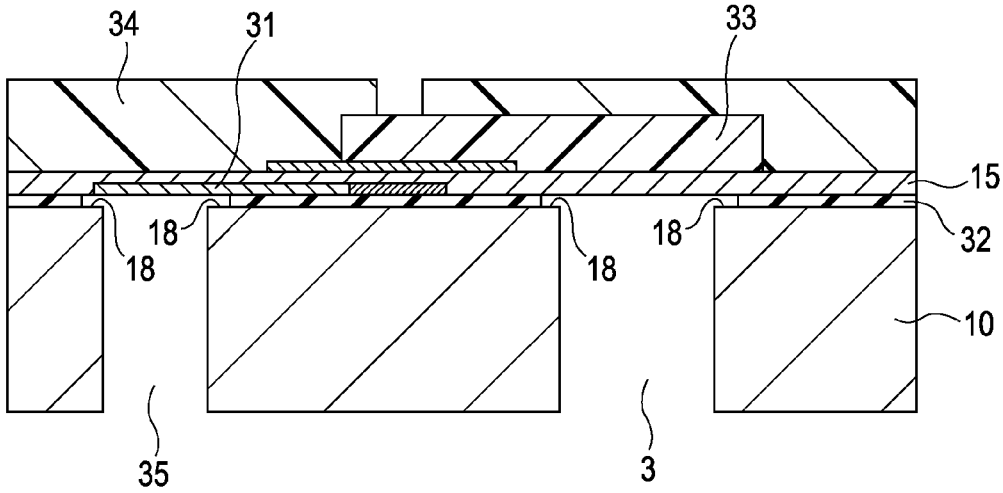

As shown in FIG. 8B, in order to set back the silicon dioxide layer 32 from the supply port 3 and the through-holes 35, the silicon dioxide layer 32 is over-etched for a predetermined time, whereby recesses 18 are formed in the walls of the through-holes 35 and the wall of the supply port 3. In this embodiment, the silicon dioxide layer 32, which is one of functional layers, is used as a sacrificial layer.

Figure 8C:
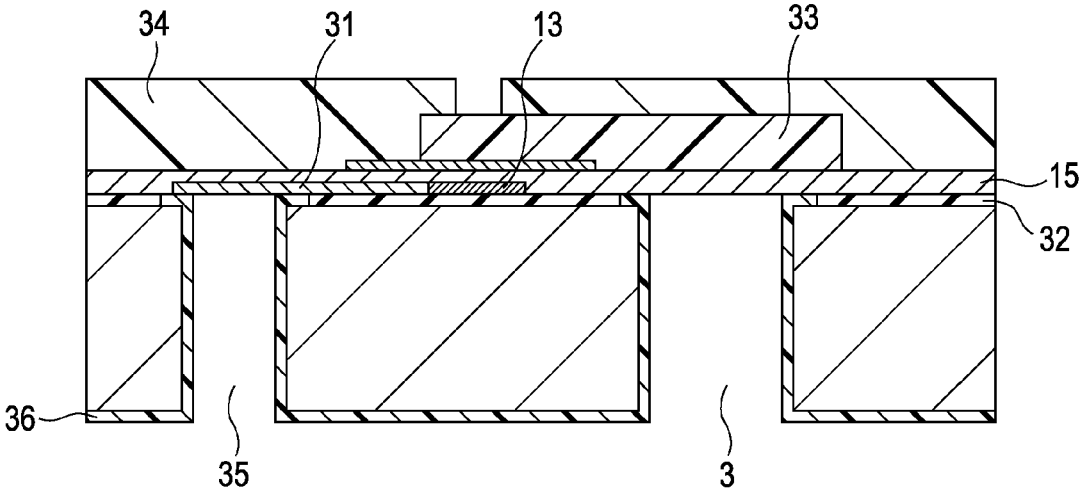

As shown in FIG. 8C, a poly(p-xylylene) film 36 for forming an insulating layer and a protective layer is deposited over the rear surface of a substrate 10 by CVD. In this operation, the recesses 18 are filled with portions of the poly(p-xylylene) film 36.

A dry film resist is deposited on the poly(p-xylylene) film 36, exposed, and then developed, whereby portions of the dry film resist that are located on the through-holes 35 and the supply port 3 are removed.

After portions of the poly(p-xylylene) film 36 that are located at the bottoms of the through-holes 35 and the bottom of the supply port 3 are removed by RIE, the dry film resist is removed from the rear surface of the substrate 10.

Figure 9A:
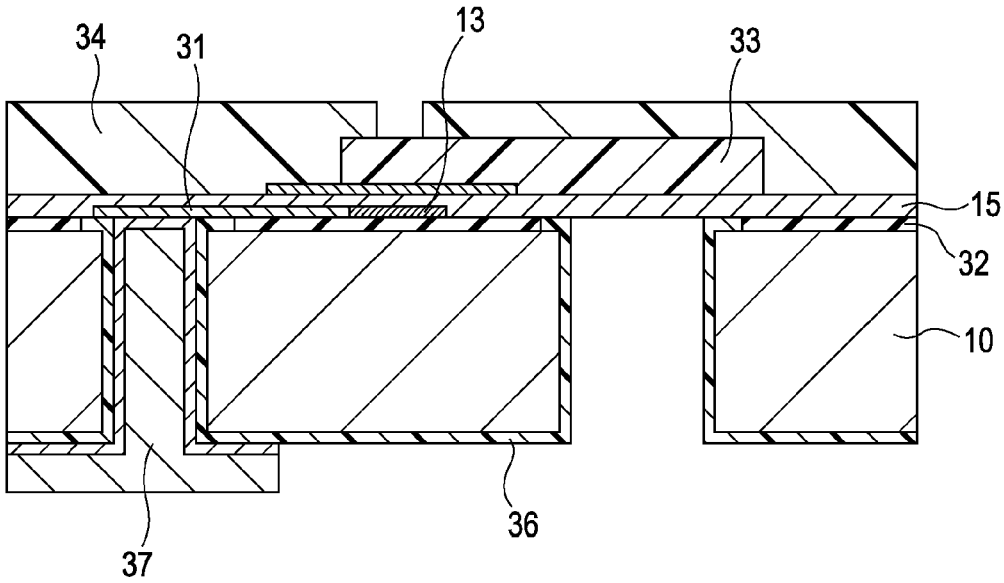
FIGS. 9A and 9B are schematic sectional views illustrating steps of the method according to the eighth embodiment.

As shown in FIG. 9A, gold is deposited on the rear surface of the substrate 10 by sputtering, whereby a plating base layer is formed. A photosensitive dry film is attached to the plating base layer and then patterned by photolithography such that regions not used to form conductive layers are masked.

A gold coating 37 for forming through-hole electrode layers and rear-surface conductive layers is formed on the plating base layer by plating in such a manner that a voltage is applied to the plating base layer. The photosensitive dry film is peeled off and portions of the plating base layer that are uncovered with the gold coating 37 are then removed.

Figure 9B:
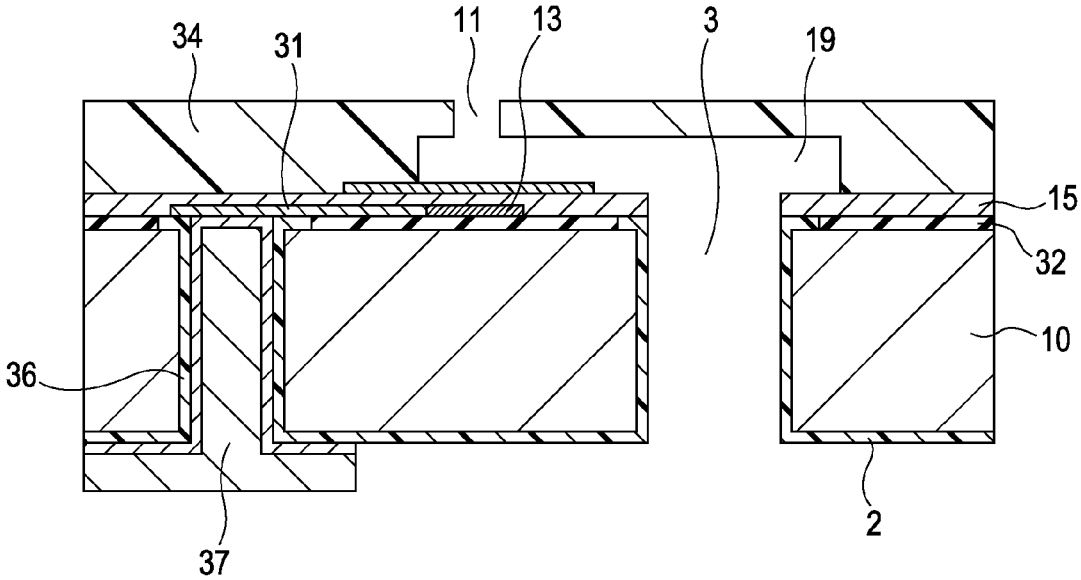

As shown in FIG. 9B, after a portion of the passivation layer 15 that is exposed at the opening of the supply port 3 is removed by CDE, a soluble resin layer 33 is removed in such a manner that the substrate 10 is immersed in methyl lactate.

The substrate 10 is heated to a temperature at which wax is melted, whereby a support plate is released from the substrate 10. The substrate 10 is cut with a dicer, whereby a chip is prepared. A cartridge is assembled in such a manner that the chip is attached to a chip plate and the rear-surface conductive layers are connected to external electrodes, whereby the recording head shown in FIG. 3 is completed.

Ninth Embodiment

Figure 11A:
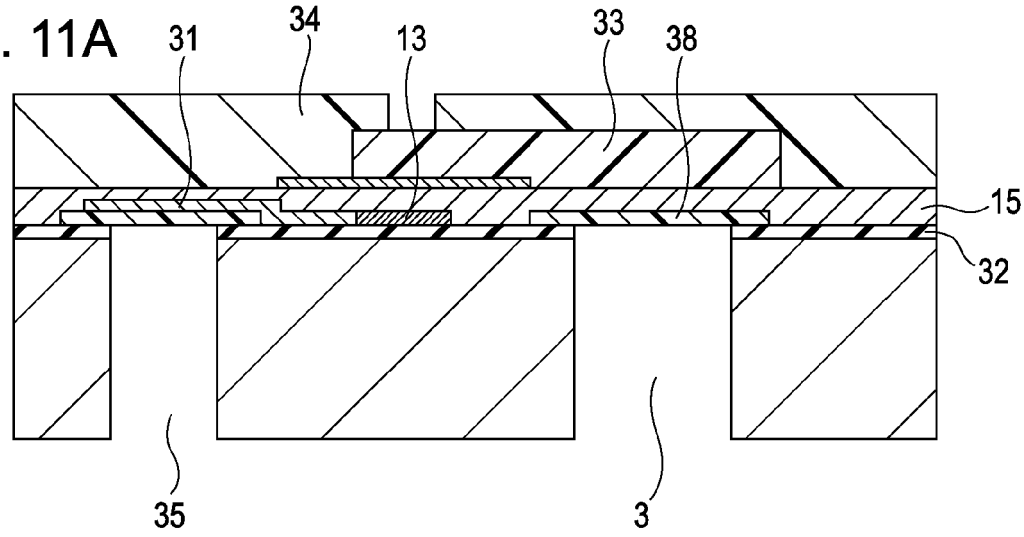
FIGS. 11A to 11C are schematic sectional views illustrating steps of a method for manufacturing an ink-jet recording head according to a ninth embodiment of the present invention.

A method for manufacturing a recording head according to a ninth embodiment of the present invention will now be described with reference to FIGS. 11A to 11C and 12A to 12C. In this embodiment, a recording head having the same configuration as that of the recording head shown in FIG. 10A or 10B can be obtained. In the step illustrated in FIG. 5A, a sacrificial layer 38 is formed on a silicon dioxide layer 32. An electrode layer 31 and a passivation layer 15 are formed on the sacrificial layer 38 in that order. The steps shown in FIGS. 5B, 5C, and 6A are performed. Portions of the silicon dioxide layer 32 that are exposed at the bottoms of the through-holes 35 and the bottom of the supply port 3 are removed by RIE, whereby the sacrificial layer 38 is exposed as shown in FIG. 11A.

Figure 11B:
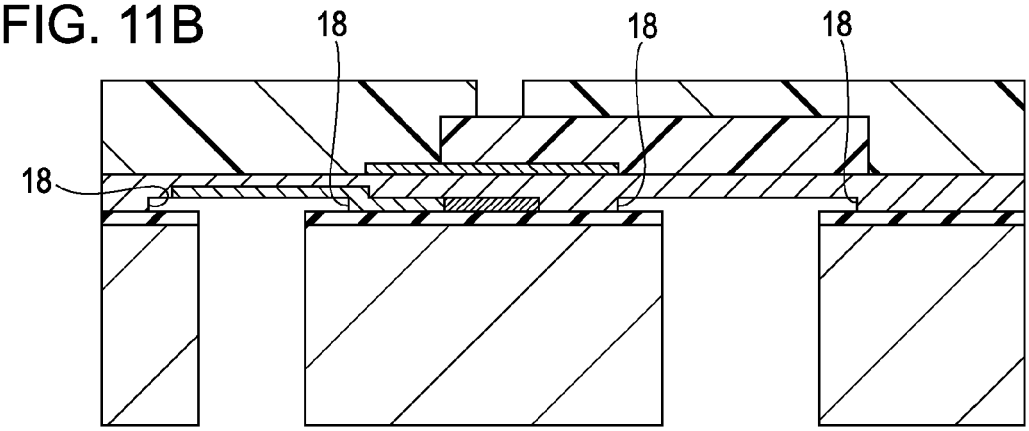

The sacrificial layer 38 is entirely removed as shown in FIG. 11B. In this embodiment, since the sacrificial layer 38 is entirely removed, a region in which a protective layer extends can be precisely defined. Since the sacrificial layer 38 is etched more rapidly than other layers, any material may be used to form the sacrificial layer 38 if the sacrificial layer 38 can be formed so as to have a thickness less than that of the protective layer, which is formed in a subsequent step.

The sacrificial layer 38 may be an aluminum thin film that can be removed with a mixture of phosphoric acid, acetic acid, and nitric acid. If through-hole electrodes are formed in this operation, a layer of a barrier metal can be formed between the sacrificial layer 38 and electronic circuit layer 31 disposed above the sacrificial layer 38 in advance. The barrier metal can be selected from the group consisting of titanium, titanium nitride, and tantalum nitride.

Alternatively, the sacrificial layer 38 may be a boron-doped phosphorus silicate glass (BPSG) film. In this case, the sacrificial layer 38 can be removed by CDE using a fluorine-containing gas such as $CF_4$ or by wet etching using BHF. In general, the etching rate of BPSG is large. It is important to set the thickness of the sacrificial layer 38 and that of the silicon dioxide layer 32 in view of the etching rate of the silicon dioxide layer 32, which is to be contacted with an etchant. The sacrificial layer 38 can have a thickness of, for example, 6,000 Å and the silicon dioxide layer 32 can have a thickness of, for example, 7,000 Å or more.

Figure 11C:
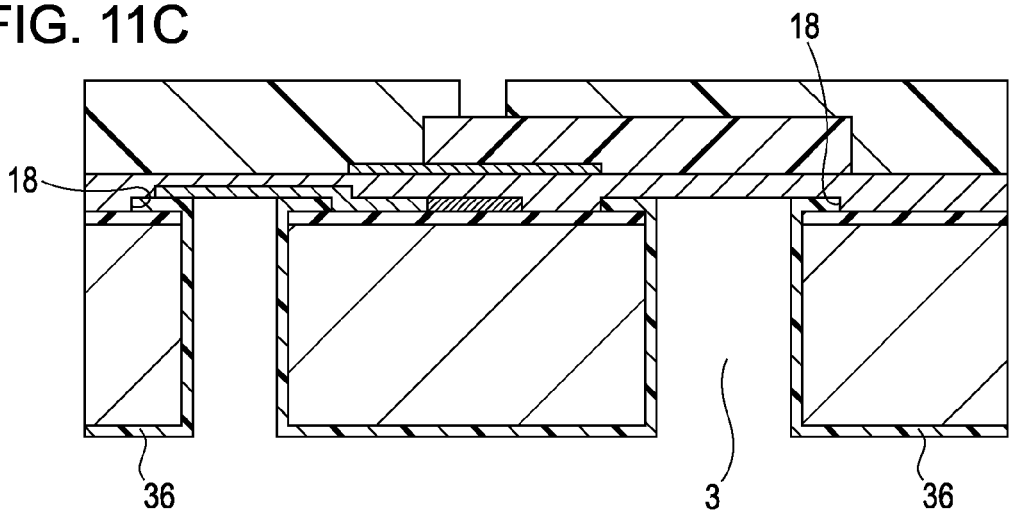

A poly(p-xylylene) film 36 for forming an insulating film 17 and a cover film 2 is deposited over the rear surface of the substrate 10 by CVD. In this operation, recesses 18 are filled with portions of the poly(p-xylylene) film 36. A dry film resist is deposited on the poly(p-xylylene) film 36, exposed, and then developed, whereby portions of the dry film resist that are located on through-holes 35 and a supply port 3 are removed. After portions of the poly(p-xylylene) film 36 that are located at the bottoms of the through-holes 35 and the bottom of the supply port 3 are removed by RIE, the dry film resist is removed from the rear surface of the substrate 10 as shown in FIG. 11C.

Gold is deposited on the rear surface of the substrate 10 by sputtering, whereby a plating base layer is formed. A photosensitive dry film is attached to the plating base layer and then patterned by photolithography such that regions not used to form conductive layers are masked. A gold coating 37 for forming through-hole electrode layers 1 and rear-surface conductive layers is formed on the plating base layer by plating in such a manner that a voltage is applied to the plating base layer. The photosensitive dry film is peeled off and portions of the plating base layer that are uncovered with the gold coating 37 are then removed as shown in FIG. 12A.

Figure 12A:
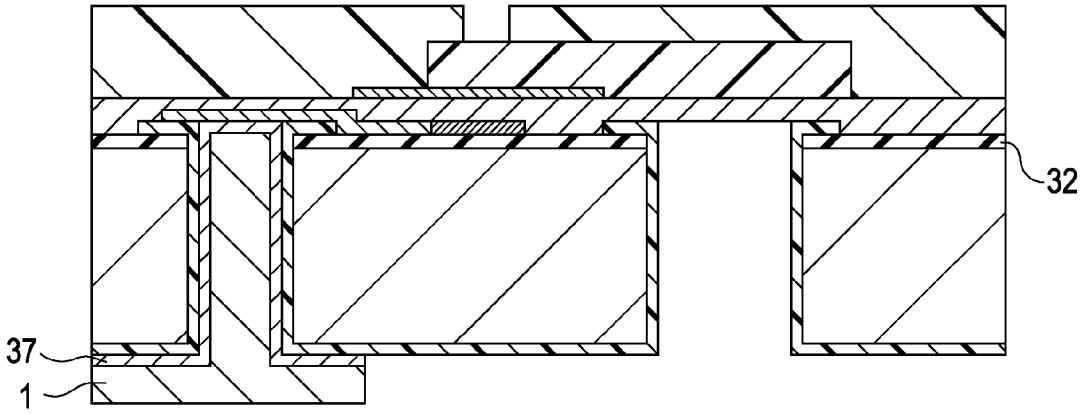
FIGS. 12A to 12C are schematic sectional views illustrating steps of the method according to the ninth embodiment.
Figure 12B:
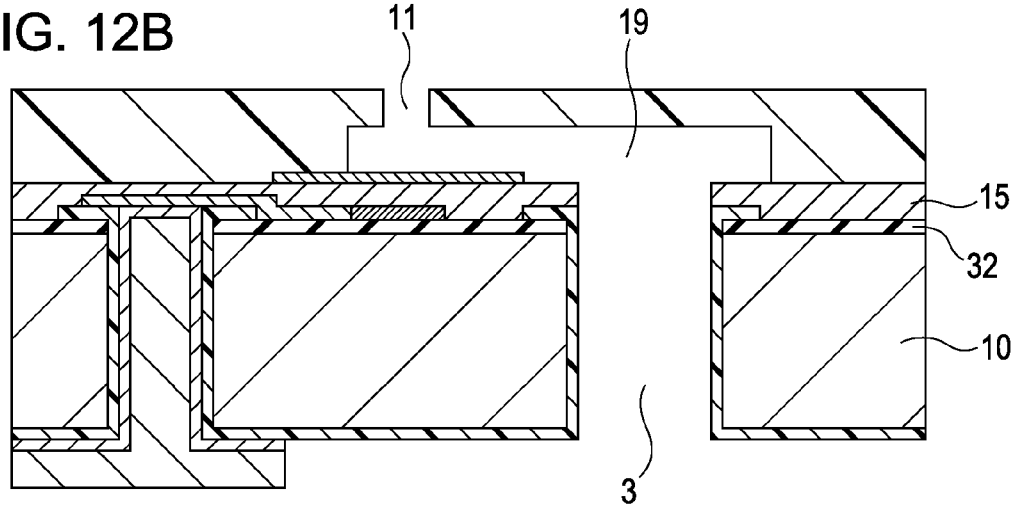

As shown in FIG. 12B, after a portion of the passivation layer 15 that is exposed at the bottom of the supply port 3 is removed by CDE, a soluble resin layer 33 is removed in such a manner that the substrate 10 is immersed in methyl lactate.

The substrate 10 is heated to a temperature at which wax is melted, whereby a support plate is released from the substrate 10. The substrate 10 is cut with a dicer, whereby a chip is prepared. A cartridge is assembled in such a manner that the chip is attached to a chip plate and the rear-surface conductive layers are connected to external electrodes, whereby the recording head having the same configuration as that shown in FIG. 10A is completed.

Figure 12C:
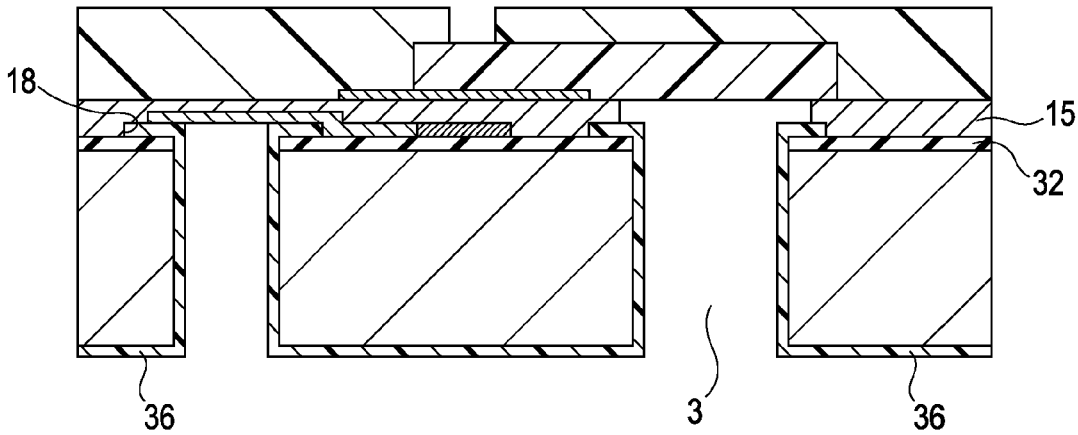

Alternatively, after the step illustrated in FIG. 12A, an end portion of the passivation layer 15 that is located on the supply port side may be removed as shown in FIG. 12C. A process for removing the end portion thereof can be selected from the group consisting of CDE, wet etching, and dry etching depending on a material for forming the passivation layer 15. In this operation, the passivation layer 15 is side-etched; hence, an end of the passivation layer 15 is set back from the wall of the supply port 3.

The step illustrated in FIG. 12B is performed, whereby the recording head having the same configuration as that shown in FIG. 10B can be obtained.

Tenth Embodiment

Figure 14:
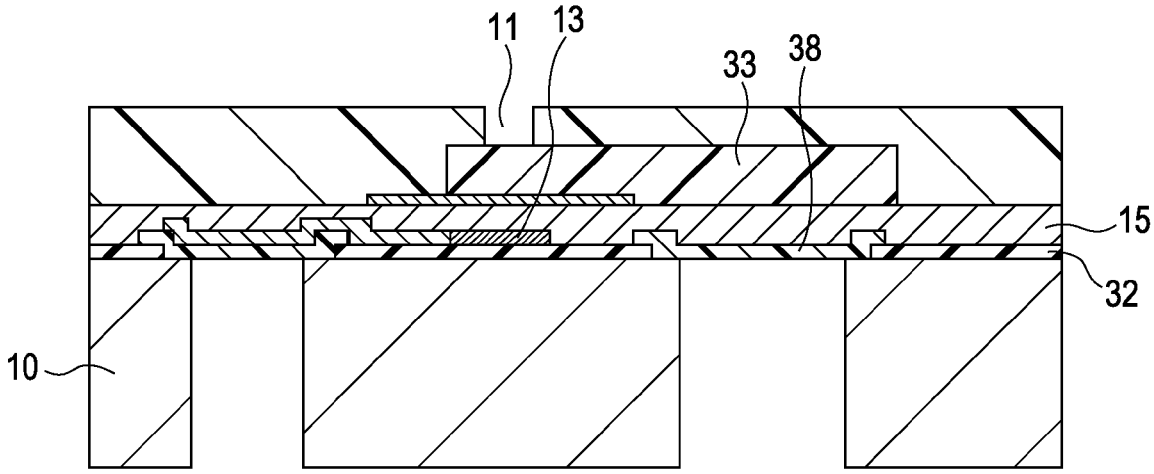
FIG. 14 is a schematic sectional view illustrating a step of a method for manufacturing an ink-jet recording head according to a tenth embodiment of the present invention.

A method for manufacturing a recording head according to a tenth embodiment of the present invention will now be described with reference to FIG. 14. The configuration shown in FIG. 14 is different from that shown in FIG. 11A as described below. In the recording head, ends of a silicon dioxide layer 32, which is disposed on a substrate 10 and which functions as an interlayer insulating layer, are set back from positions for forming through-hole electrodes and a position for forming a supply port. Furthermore, a sacrificial layer 38 extends over the positions for forming the through-hole electrodes, the position for forming the supply port, the substrate 10, and the silicon dioxide layer 32. Other members of the recording head are the same as those described in the ninth embodiment. A workpiece having the configuration shown in FIG. 14 is processed in the same manner as that described in the ninth embodiment, whereby the recording head can be manufactured so as to have the same configuration as that shown in FIG. 13.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-001477 filed Jan. 9, 2007 and No. 2007-290676 filed Nov. 8, 2007, which are hereby incorporated by reference herein in their entirety.

What is claimed is:

1. An ink-jet recording head comprising:

a substrate including a first surface, a second surface opposed to the first surface, energy-generating elements arranged above the first surface and configured to generate energy used to discharge ink, and layers provided at the first surface;

discharge ports through which the ink is discharged and being arranged to correspond to the energy-generating elements;

ink channels communicatively connected to the discharge ports;

a supply port extending from the first surface to the second surface of the substrate and communicatively connected to the ink channels; and a film covering an inner wall of the supply port, wherein the film extends to the first surface of the substrate and a portion of the film that extends to the first surface is sandwiched in the layers.

2. The ink-jet recording head according to claim 1, wherein the substrate is made of silicon.

3. The ink-jet recording head according to claim 1, wherein the layer extends over the energy-generating elements.

4. The ink-jet recording head according to claim 3, wherein the layer is made of silicon nitride.

5. The ink-jet recording head according to claim 4, wherein the film extends on a silicon dioxide layer disposed on the first surface of the substrate.

6. The ink-jet recording head according to claim 1, wherein the film contains poly(p-xylylene).

7. The ink-jet recording head according to claim 1, wherein the layer has an end portion set back from the wall of the supply port.

* * * * *